US007147403B2

(12) United States Patent
Bennett, Jr. et al.

(10) Patent No.: US 7,147,403 B2
(45) Date of Patent: Dec. 12, 2006

(54) SELF-ELEVATING OFFSHORE STRUCTURE

(75) Inventors: William T. Bennett, Jr., Metairie, LA (US); William T. Bennett, III, Metairie, LA (US); Jacob H. Alford, New Orleans, LA (US); Jose H. Vazquez Gonzalez, New Orleans, LA (US)

(73) Assignee: Bennett and Associates, LLC, Houston, TX (US)

( * ) Notice: Subject to any disclaimer, the term of this patent is extended or adjusted under 35 U.S.C. 154(b) by 485 days.

(21) Appl. No.: 10/610,033

(22) Filed: Jun. 30, 2003

(65) Prior Publication Data

US 2006/0062636 A1 Mar. 23, 2006

Related U.S. Application Data

(60) Provisional application No. 60/393,350, filed on Jul. 1, 2002.

(51) Int. Cl.
*E02B 17/08* (2006.01)

(52) U.S. Cl. ..... 405/196; 405/209; 405/198; 405/199

(58) Field of Classification Search ..... 405/196–200, 405/203–206, 209
See application file for complete search history.

(56) References Cited

U.S. PATENT DOCUMENTS

| | | | | |
|---|---|---|---|---|
| 3,044,269 | A * | 7/1962 | Tourneau | 405/198 |
| 4,065,934 | A * | 1/1978 | Dysarz | 405/196 |
| 4,161,376 | A * | 7/1979 | Armstong | 405/196 |
| 5,855,455 | A * | 1/1999 | Williford et al. | 405/196 |
| 6,293,734 | B1 * | 9/2001 | Thomas et al. | 405/209 |

* cited by examiner

*Primary Examiner*—Frederick L. Lagman
(74) *Attorney, Agent, or Firm*—Keaty Professional Law Corporation

(57) ABSTRACT

A self-elevating offshore structure supports a deck for production operations at sea in the absence of an elevating hull. A non-buoyant deck is supported by braces and truss legs above wave action. The legs move in relation to the legs and the braces, elevating the deck and the braces supporting the deck. The offshore structure is transported to a deployment site by a buoyant vessel and then released from the vessel once the legs are embedded into the sea bottom.

25 Claims, 5 Drawing Sheets

SELF-ELEVATING OFFSHORE STRUCTURE

CROSS-REFERENCE TO RELATED APPLICATIONS

This nonprovisional application is based on and claims the benefit of our provisional application Ser. No. 60/393,350 filed on Jul. 1, 2002, entitled "Self-elevating Offshore Structure," the full disclosure of which is incorporated by reference herein.

BACKGROUND OF THE INVENTION

The present invention relates to an oil and gas industry, and, more particularly to a self-elevating offshore structure that can be used for developing and production of wells in an offshore location. Even more particularly, the invention relates to a truss structure that can be used in a self-elevating unit without the need to provide a buoyant hull.

Self-elevating units are extensively used in the oil and gas industry, and numerous designs of such structures are available from shipyards and naval architects. Conventionally, self-elevating units have a plurality of supporting legs, either of tubular or trusswork constructions and a buoyant hull of a barge-type construction. Conventionally, the unit transports itself to a deployment site, the legs are elevated above the hull and the unit is floated on its own buoyant hull. During transport to a deployment site for the current application, the legs are elevated above the truss structure and the truss unit is loaded onto transport barges. Once the unit is delivered to the site of the operation, the legs are lowered and embedded into or engaged with the ocean floor.

Conventional installation operation continues with the truss work that is still in rigid connection with the transport barge being elevated to impose loads onto each spudcan or footing by lifting the weight of the transport barge. Additionally the hull of the transport barge can be ballasted with seawater to apply the necessary loads to the legs to simulate the loads that can be achieved in the operational conditions. Once the preloading of the footing is established, the water is drained from the transport barge hull.

The rigid connections between the trussed deck of the elevating unit and the transport barge are removed, thereby leaving the transport barge hanging on a tension only connection. The hull of the transport barge is lowered back into the water and completely disengaged from the truss deck unit. The truss deck unit is finally elevated to the operational height above the anticipated wave action, and the unit is ready for the offshore operations.

If the offshore unit is used for production operations, the owners avoid installation of the equipment in the hull due to a potential of an explosive atmosphere in confined spaces. As a result, the majority of the hull remains unused during the production operations. Eventually, the buoyant hull of a conventional unit becomes a maintenance problem.

The present invention contemplates elimination of drawbacks associated with the prior art and provision of an offshore structure that does not use a buoyant hull.

SUMMARY OF THE INVENTION

It is, therefore, an object of the present invention to provide an offshore self-elevating structure that incorporates no buoyant hull.

It is another object of the present invention to provide a self-elevating non-buoyant structure particularly adapted for production operations.

It is a further object of the present invention to provide a self-elevating offshore structure that uses the buoyant transport vessel for pre-loading the footing.

These and other objects of the present invention are achieved through a provision of a self-elevating offshore structure that has no buoyant hull. A non-buoyant deck is supported on a framework of braces, with the deck and braces supported at operational level by truss legs. The legs move in relation to the deck and the brace assemblies with the assistance of jack-up units mounted on the brace assemblies and engaging the legs chords at the intersection of the braces and the leg chords.

The offshore structure is transported to a deployment site by a buoyant vessel, such as a barge, with the deck releasably secured to the barge for temporary transit. During transit, the legs extend above the water surface. Once the vessel reaches the deployment location, the legs are lowered for embedding into the sea bottom. The transport vessel, while still secured to the offshore structure, is ballasted to provide sufficient loadings on the legs to simulate operational and environmental loads.

After the legs are properly secured, the structure is released from the vessel, and the jack-up units elevate the structure to an operation level. The absence of the buoyant hull solves a major maintenance problem associated with platforms that incorporate buoyant hulls as part of the structure.

BRIEF DESCRIPTION OF THE DRAWINGS

Reference will now be made to the drawings, wherein like parts are designated by like numerals, and wherein.

DETAIL DESCRIPTION OF THE PREFERRED EMBODIMENT

Figure 1:
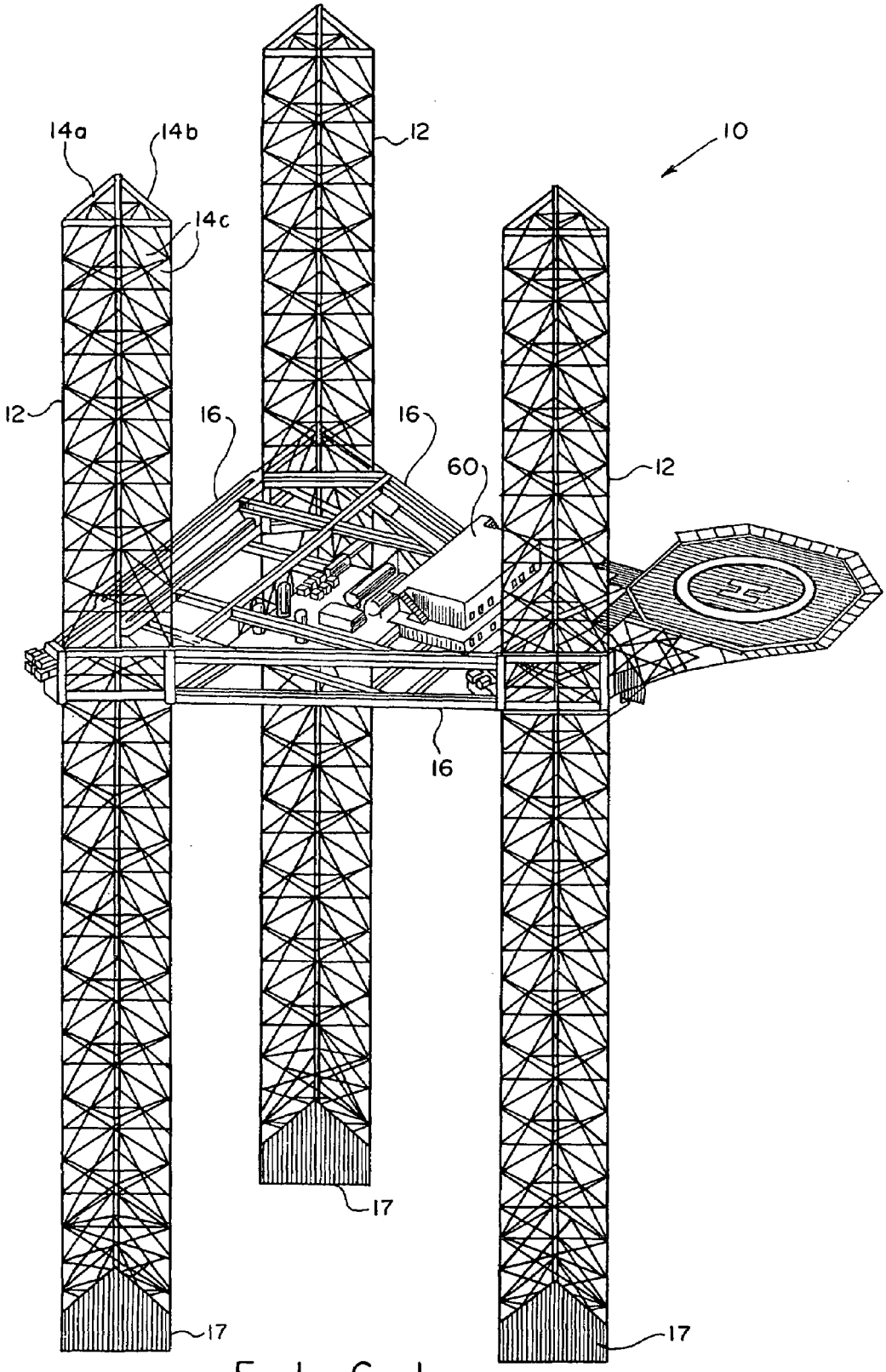
FIG. 1 is a perspective view of the offshore structure of the present invention.
Figure 2:
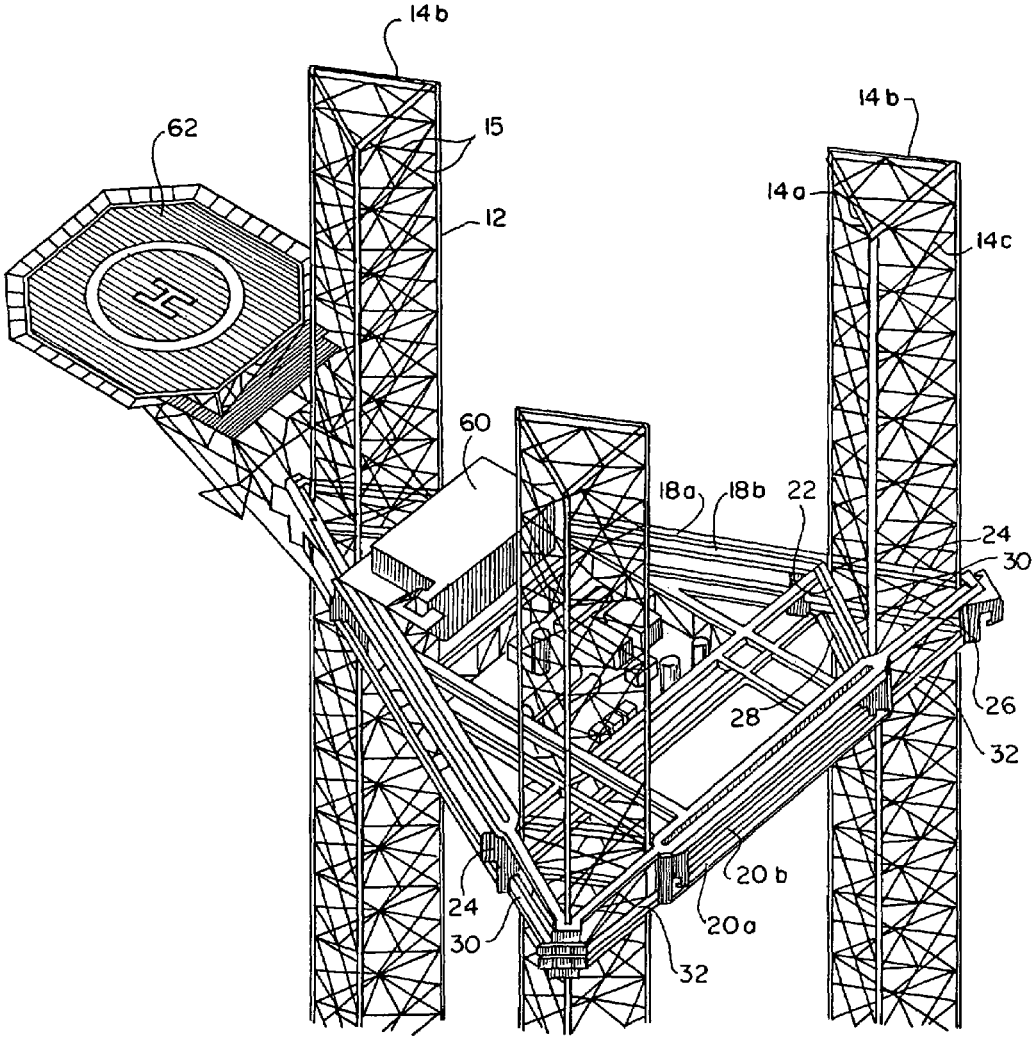
FIG. 2 is a detail view of the offshore structure with the trusswork shown in more detail.
Figure 3:
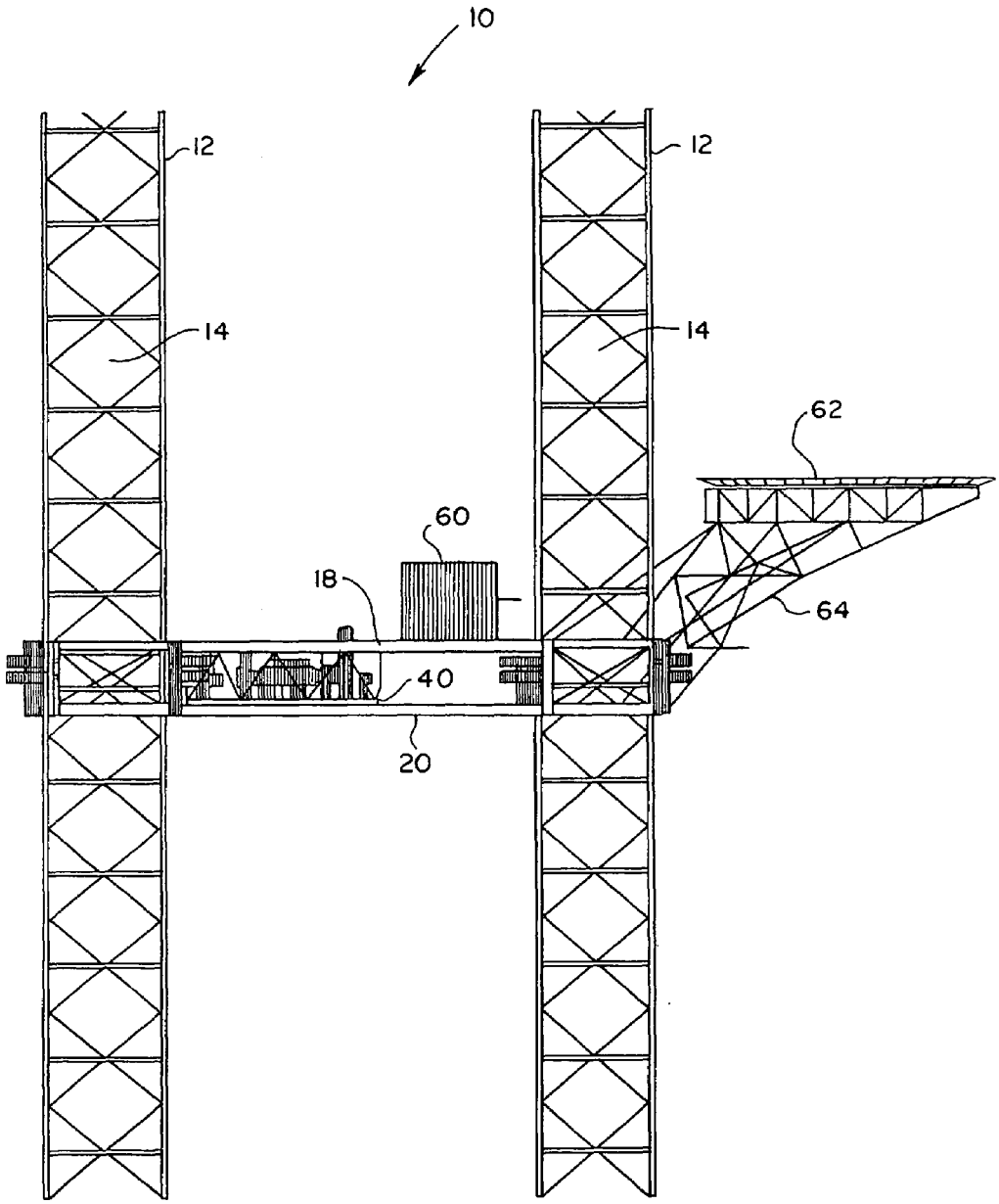
FIG. 3 is a starboard view of the offshore structure of the present invention.

Turning now to the drawings in more detail, numeral 10 designates the offshore structure of the present invention. The structure 10 comprises a plurality of leg members 12, which can be three or more in number. Each leg member 12 comprises leg faces 14*a*, 14*b* and 14*c* held in spatial relationship by leg braces 15 usually of tubular or trusswork construction.

Secured to the legs 12 and extending between the legs 12 is a plurality of horizontal bracing assemblies 16. Each bracing assembly 16 comprises at least one upper brace 18 and at least one lower brace 20. In a preferred embodiment, the bracing assembly 16 comprises a pair of upper parallel braces, or trusses 18*a* and 18*b*, and pair of lower parallel braces, or trusses 20*a* and 20*b*. The bracing assemblies 16 retain the legs 12 in a pre-determined spatial relationship to each other.

Each bracing assembly 16 further comprises upper leg securing braces 22, 24 and 26 and lower leg securing braces 28, 30 and 32. The leg securing brace member 22 extends between upper brace members 18*a* of adjacent bracing assemblies 16, across the face 14*a* of the leg 12. The leg securing brace member 24 extends across the outside face 14*b*, and the leg securing brace member 26 extends across the leg face 14*c*.

The lower leg securing braces 28, 30, 32 extend across the leg faces 14*a*, 14*b* and 14*c* on a vertical level below the leg securing brace members 22, 24 and 26, respectively. Jack-up units 90 may be positioned at the intersections between the pairs of leg securing braces 22–28 and 24–30; 24–30 and 25–32 and 26–32 and 22–28.

The leg securing bracing members 22, 24, and 26 define an upper leg-receiving triangle, the leg securing braces 28, 30 and 32 define a lower leg-receiving triangle. The legs 12 move within the upper and lower triangles defined by the leg securing braces with the assistance of conventional jack-up units 90.

The bracing assemblies 16 inscribe an area between the legs 12 that can be used for supporting a platform, or deck structure 40, on which the production equipment, such as tanks, pumps and other necessary equipment can be positioned. The deck 40 is a non-buoyant body; while supporting the required equipment, it needs little maintenance in comparison to traditional buoyant hulls. The open structure provides no spaces for the hydrocarbons to collect significantly reducing the possibility of explosion on the offshore structure. In the event of an explosion in the production equipment, the open truss work structure offers far less projected area than a buoyant hull and therefore will be less likely to suffer damage from such an event.

Figure 4:
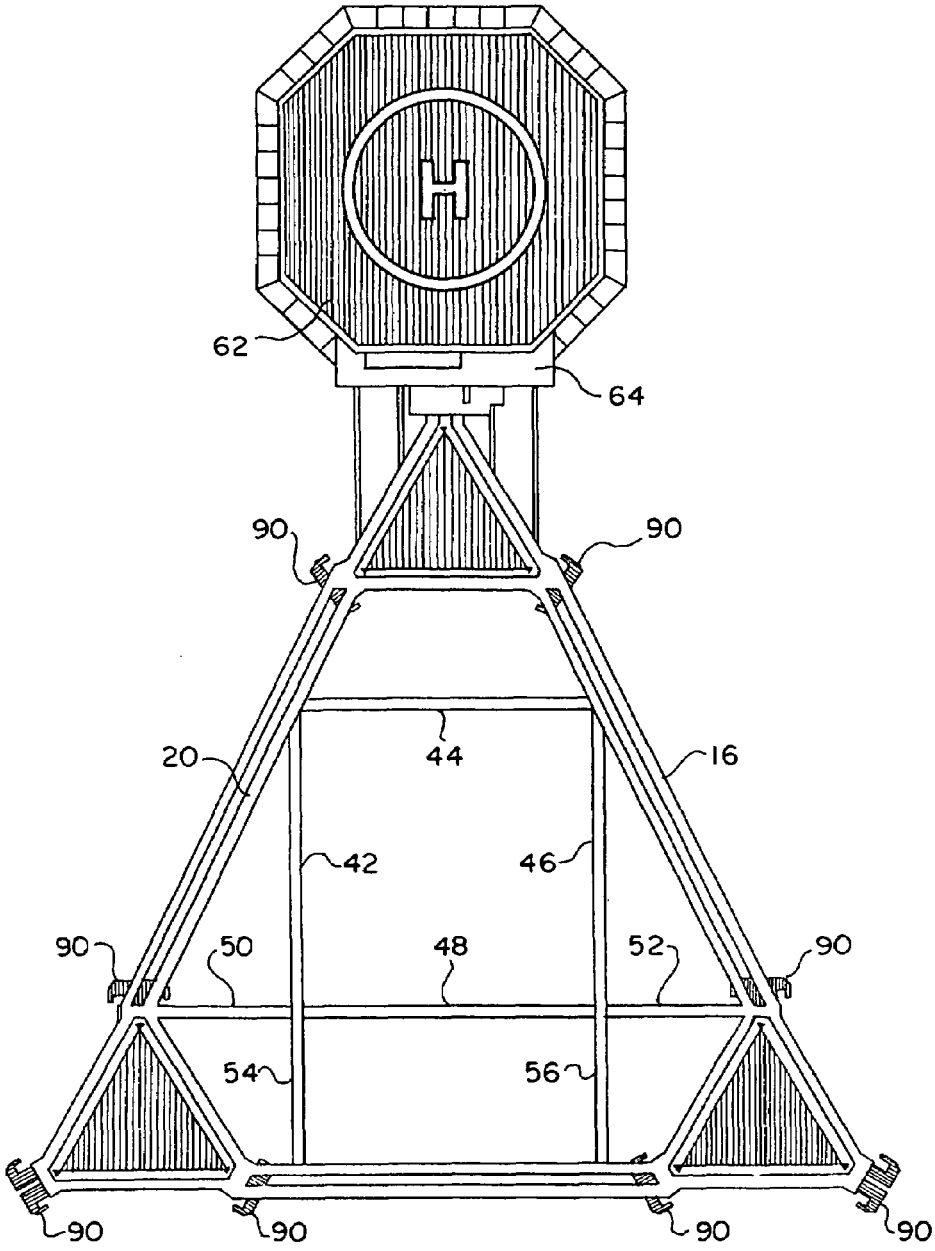
FIG. 4 is a top view of the trusswork used in the structure of the present invention.

As can be seen in FIG. 4, a separate framework of braces, more specifically deck-supporting lower brace members 42, 44, 46 and 48 support the deck 40. The deck-supporting members 42, 44, 46, and 48 form a rectangle or square that extends at an approximately the same horizontal level as the lower braces 20*a* and 20*b*. Subject to the spacing of the legs of the unit, the internal bracing may have to be either simplified or added To further reinforce the trusswork and connection between the legs 12, the present invention provides for the use of connecting members 50, 52, 54 and 56 (FIG. 4). The connecting members 50 and 52 form extensions of the supporting brace members 48 on an upper and lower level. The connecting members 54 and 56 form extension of supporting brace members 42, 46, respectively, on an upper and lower level.

Spaces for operational controls and living quarters may be housed in a building 60, which is supported by the upper truss members 18*a*, above and at a distance away from the main production deck 40. A conventional heliport 62 may be provided on a separate cantilever support structure 64.

Figure 5:
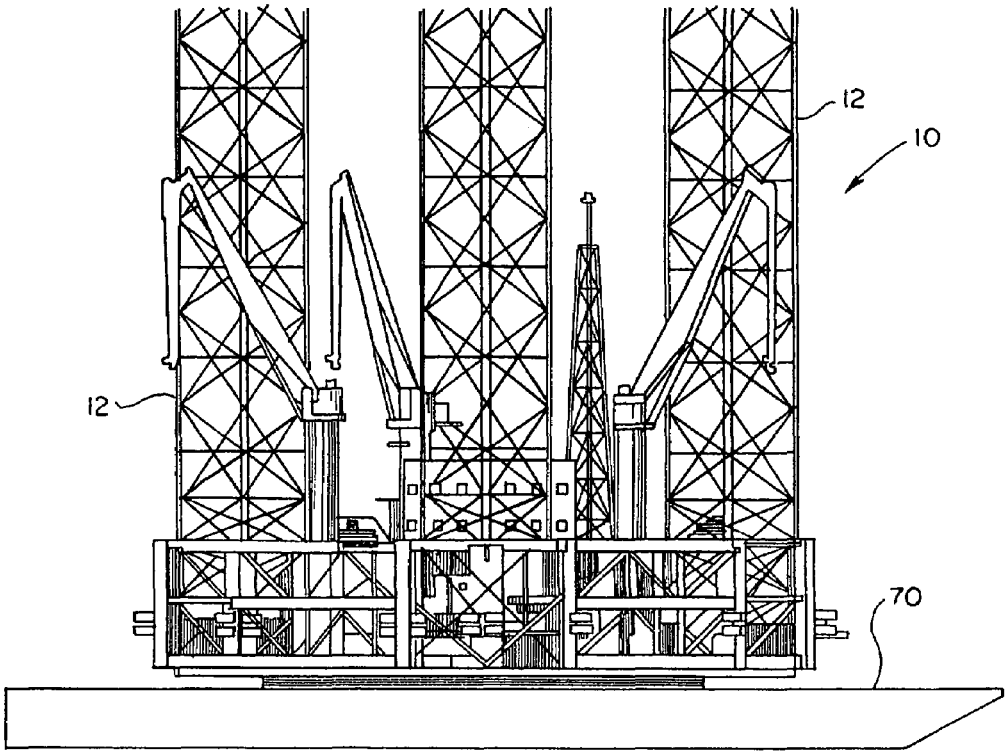
FIG. 5 is a perspective view of the structure of the present invention being transported to the operation site on a transport barge.
Figure 6:
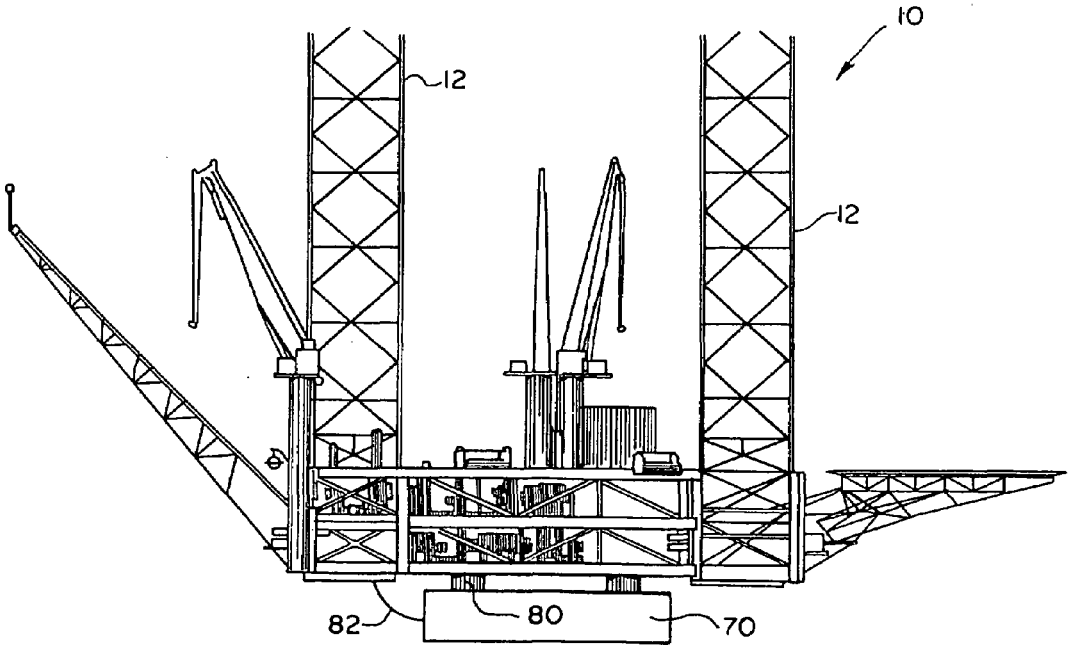
FIG. 6 is a starboard view of the structure of the present invention being transported to the operation site on a transport barge.

When delivering the structure 10 to the deployment site, a transport vessel 70 is conventionally used. During transport the legs 12 are raised, as shown in FIGS. 5 and 6. The deck 40 is temporarily secured to the vessel 70 for the transit time with the securing means 80. Once the vessel arrives on the site of the production operations, the hull of the vessel 70 is ballasted with seawater. The legs 12 are lowered to the ocean floor and the footings of the legs 12 are pre-loaded for anticipated environmental and/or operational loads. This task is accomplished by raising the deck 40 and the transport vessel 70, together with any ballast water that may be required, to a pre-determined level to apply sufficient vertical loads on the legs 12 and simulate operating and environmental loads.

Once the footings 17 of the legs 12 are pre-loaded, the rigid attachment of the jack-up unit 10 through the securing means 80 to the transport barge 70 is removed, leaving the barge 70 hanging by a flexible tension means 82 from the jack-up unit 10. The jacking assemblies engage the legs 12 to lower the deck 40 with the associated brace assemblies 16 and the attached vessel 70 back into the water, thereby re-floating the transport barge 70 without disturbing the preloaded foundation of the legs 12. The vessel 70 is then disengaged from the structure 10 and moved away. The deck 40 and the supporting bracing assemblies 16 are then raised to the operating level and locked in position ready for the start of the operations.

The use of trusswork instead of a closed buoyant hull allows to significantly reduce the elevated weight of the unit and therefore the associated dynamic response. The trusswork structure results in a safer facility, improved operating characteristics and reduced cost.

Many changes and modifications may be made in the design of the present invention without departing from the spirit thereof. We, therefore, pray that our rights to the present invention be limited only by the scope of the appended claims.

We claim:

1. An offshore structure suitable for production operations at sea, comprising at least one non-buoyant deck supportable on a transport vessel during transit to a deployment location at sea, a plurality of brace assemblies supporting said deck at an operational level at sea without a buoyant hull, and a plurality of legs supporting said deck and said brace assemblies above sea wave action, each of said plurality of legs being adapted for embedding into a sea bottom while said deck is supported by the transport vessel and being adapted to receiving sufficient loading on leg footings from said transport vessel during embedding into the sea bottom to simulate operating and environmental loads.

2. The offshore structure of claim 1, wherein said plurality of brace assemblies comprise non-buoyant members.

3. The offshore structure of claim 1, wherein said plurality of brace assemblies comprise leg receiving brace members, said leg receiving brace members defining openings for extension of the legs therethrough.

4. The offshore structure of claim 1, further comprising a means for releasably securing said offshore structure to the transport vessel, said securing means retaining said offshore structure deck on the transport vessel during transit to the deployment location at sea.

5. The offshore structure of claim 4, wherein lower portions of each of said plurality of legs are adapted for embedding into a sea bottom while said securing means retain said deck attached to the transport vessel.

6. The offshore structure of claim 5, further comprising a tension means for temporarily engaging the transport vessel while the transport vessel is being lowered into water without disturbing embedment of the legs into the sea bottom.

7. The offshore structure of claim 1, wherein said brace assemblies retain said plurality of legs in a spatial relationship to each other.

8. The offshore structure of claim 1, wherein each of the brace assemblies comprises a plurality of upper brace members and a plurality of lower brace members oriented in a substantially parallel relationship to the upper brace members.

9. The offshore structure of claim 8, wherein each of said brace assemblies further comprises upper leg securing braces and lower leg securing braces, said upper and said lower leg securing braces inscribing areas, within which the plurality of legs move in relation to said deck.

10. The offshore structure of claim 1, further comprising jack up assemblies to facilitate movement of said plurality of legs in relation to said deck and said brace assemblies between a non-operation position extending above the water surface and an embedded position with footings of the plurality of legs embedded into a sea bottom.

11. An offshore structure suitable for production operations at sea, comprising: at least one non-buoyant deck for supporting production equipment; a plurality of brace assemblies supporting said deck at an operational level at sea without a buoyant hull; a plurality of truss legs supporting said deck and said brace assemblies above sea wave action; and a means for moving said legs in relation to said deck and said brace assemblies between a position above water surface and a position with footings of the legs embedded into the sea bottom, said truss legs being adapted to receive loadings from said transport vessel during embedment of said footings of the legs in the sea bottom, wherein said loadings received by said legs simulate operational and environmental loads encountered by said offshore structure during offshore operations.

12. The offshore structure of claim 11, further comprising a means for temporarily releasably securing said offshore structure on a transport vessel.

13. The offshore structure of claim 11, further comprising a tension means for temporarily engaging the transport vessel while the transport vessel is being lowered into water without disturbing embedment of the legs into the sea bottom.

14. The offshore structure of claim 11, wherein each of the brace assemblies comprises a plurality of upper brace members and a plurality of lower brace members oriented in a substantially parallel relationship to the upper brace members.

15. The offshore structure of claim 14, wherein said plurality of brace assemblies comprise leg receiving brace members, said leg receiving brace members defining openings for extension of the legs therethrough, said leg receiving members carrying said means for moving said legs.

16. The offshore structure of claim 11, wherein said means for moving said legs comprise a plurality of jacking units secured between said braces and said truss legs.

17. An offshore structure, comprising: at least one non-buoyant deck; a plurality of brace assemblies supporting said deck at an operational level at sea; a plurality of truss legs supporting said deck and said brace assemblies above sea wave action; said offshore structure being adapted for transporting to a deployment site by an independent releasable transport means and is adapted for supporting operations at sea in the absence of a buoyant hull, each of said plurality of legs being adapted for embedding into a sea bottom while said deck is supported by the transport means and being adapted to receiving sufficient loading on leg footings from said transport means during embedding into the sea bottom to simulate operating and environmental loads, said structure further comprising a tension means for temporarily engaging the transport vessel while the transport vessel is being lowered into water without disturbing embedment of the legs into the sea bottom.

18. The offshore structure of claim 17, further comprising a means for moving said legs in relation to said deck and said brace assemblies between a position above water surface and a position with footings of the legs embedded into the sea bottom.

19. The offshore structure of claim 17, wherein said legs are provided with footings embeddable into a sea bottom, while receiving loadings from the transport means before the transport means is released from the offshore structure.

20. The offshore structure of claim 17, wherein each of the brace assemblies comprises a plurality of upper brace members and a plurality of lower brace members oriented in a substantially parallel relationship to the upper brace members.

21. A method of deploying an offshore structure in a pre-determined location at sea, comprising the following steps:

providing an offshore structure having at least one non-buoyant deck, a plurality of brace assemblies for supporting said deck and a plurality of truss legs supporting said deck and said brace assemblies, and a means for moving said legs in relation to said deck and said brace assemblies;

providing a buoyant transport vessel and positioning said offshore structure on said transport vessel, with the legs of the offshore structure extending above the transport vessel; providing a securing means for temporarily securing said offshore structure on the transport means;

providing a flexible tension means for temporarily operationally connecting said offshore structure to said transport vessel;

delivering said offshore structure to the pre-determined location at sea; ballasting said transport vessel and lowering said legs, while activating said means for moving the legs;

transferring loads from the ballasted transport vessel to footings of the legs to simulate operational and environmental loads, while embedding the legs into a sea bottom;

elevating the deck, the brace assemblies and the transport vessel to a pre-determined elevation above the water surface, while retaining connection of the transport vessel to the deck through the tension means; and lowering the transport vessel into the water, without disturbing embedment of the legs.

22. The method of claim 21, wherein said means for moving the legs comprise jack-up units.

23. The method of claim 21, wherein said legs are provided with footings embeddable into a sea bottom.

24. The method of claim 21, wherein said plurality of brace assemblies comprise leg receiving brace members, said leg receiving brace members defining openings for extension of the legs therethrough, said leg receiving members carrying said means for moving said legs.

25. The method of claim 21, wherein each of said brace assemblies further comprises upper leg securing braces and lower leg securing braces, said upper and said lower leg securing braces inscribing areas, within which the plurality of legs move in relation to said deck.

* * * * *